US010082261B2

(12) United States Patent
Torres et al.

(10) Patent No.: US 10,082,261 B2
(45) Date of Patent: Sep. 25, 2018

(54) PIVOTABLE LIGHT FIXTURE

(71) Applicant: Milyon, LLC, Pipersville, PA (US)

(72) Inventors: Roman Torres, Philadelphia, PA (US); Ivy Silver, Pipersville, PA (US)

(73) Assignee: Milyon, LLC, Pipersville, PA (US)

( * ) Notice: Subject to any disclaimer, the term of this patent is extended or adjusted under 35 U.S.C. 154(b) by 427 days.

(21) Appl. No.: 14/876,051

(22) Filed: Oct. 6, 2015

(65) Prior Publication Data

US 2016/0102824 A1 Apr. 14, 2016

Related U.S. Application Data

(60) Provisional application No. 62/061,465, filed on Oct. 8, 2014.

(51) Int. Cl.

| | |
|---|---|
| ***F21S 8/02*** | (2006.01) |
| ***F21V 7/00*** | (2006.01) |
| ***F21V 29/83*** | (2015.01) |
| ***F21V 1/00*** | (2006.01) |
| ***F21V 14/00*** | (2018.01) |
| ***F21V 29/74*** | (2015.01) |
| ***F21V 7/05*** | (2006.01) |
| ***F21V 14/04*** | (2006.01) |
| ***F21V 29/507*** | (2015.01) |
| *F21V 23/04* | (2006.01) |
| *F21Y 115/10* | (2016.01) |

(52) U.S. Cl.

CPC ..... *F21S 8/024* (2013.01); *F21V 1/00* (2013.01); *F21V 7/0008* (2013.01); *F21V 14/00* (2013.01); *F21V 29/745* (2015.01); *F21V 29/83* (2015.01); *F21V 7/0025* (2013.01); *F21V 7/05* (2013.01); *F21V 14/04* (2013.01); *F21V 23/0485* (2013.01); *F21V 29/507* (2015.01); *F21Y 2115/10* (2016.08)

(58) Field of Classification Search

CPC ..... F21V 14/04; F21V 7/05; F21V 7/0008; F21V 7/0025; F21V 1/10; F21S 8/024

USPC ..... 362/283

See application file for complete search history.

(56) References Cited

U.S. PATENT DOCUMENTS

| | | | | |
|---|---|---|---|---|
| 3,099,403 A * | 7/1963 | Strawick | ..... | F21V 7/0025 362/224 |
| 4,222,093 A | 9/1980 | Garcia et al. | | |
| 4,519,019 A | 5/1985 | Hall | | |

(Continued)

*Primary Examiner* — William N Harris

(74) *Attorney, Agent, or Firm* — Christopher & Weisberg, P.A.

(57) ABSTRACT

A light fixture including a housing, the housing including a back portion and a plurality of side walls extending from the back portion, the back portion and the plurality of side walls defining an opening and an interior therein. A light source is affixed to the back portion within the interior. A hinge is coupled to the housing and positioned within the interior, the hinge includes a first portion and a second portion, the first portion and second portion being configured to reflect light emitted from the light source. The first portion and the second portion being movable contemporaneously from a first portion in which light from the light source is substantially entirely reflected in a first direction away from the housing to a second position in which light is substantially entirely reflect reflected away from the housing in a second direction different than the first direction.

19 Claims, 5 Drawing Sheets

(56) References Cited

U.S. PATENT DOCUMENTS

| | | | | |
|---|---|---|---|---|
| 4,651,258 | A | 3/1987 | Davis et al. | |
| 4,885,665 | A | 12/1989 | Birillo | |
| 4,967,324 | A | 10/1990 | Barclay | |
| 5,081,566 | A | 1/1992 | Crispin et al. | |
| 5,142,459 | A | 8/1992 | Swarens et al. | |
| 5,381,320 | A | 1/1995 | Jordan | |
| 5,515,252 | A | 5/1996 | Osteen et al. | |
| 5,735,593 | A | 4/1998 | Gallant et al. | |
| 5,803,585 | A | 9/1998 | Littman et al. | |
| 6,174,068 | B1 | 1/2001 | Ambach et al. | |
| 6,893,139 | B2 | 5/2005 | Cercone et al. | |
| 7,210,811 | B1 | 5/2007 | Swanson | |
| 7,401,939 | B2 | 7/2008 | Haugaard et al. | |
| 7,575,336 | B2 | 8/2009 | Yoshida et al. | |
| 7,594,734 | B2 | 9/2009 | Bacon et al. | |
| 7,607,795 | B2 | 10/2009 | Engel | |
| 8,016,456 | B2 * | 9/2011 | Paravantsos | F21V 7/005 362/217.05 |
| 8,096,670 | B2 | 1/2012 | Trott et al. | |
| 2003/0021107 | A1 | 1/2003 | Howell et al. | |
| 2005/0201082 | A1 | 9/2005 | Mauk et al. | |
| 2006/0152921 | A1 | 7/2006 | Welker | |
| 2007/0279896 | A1 | 12/2007 | Engel | |
| 2010/0165607 | A1 | 7/2010 | Russo | |
| 2010/0246186 | A1 * | 9/2010 | Chang | F21V 7/0008 362/294 |
| 2012/0307486 | A1 * | 12/2012 | Gordin | F21V 7/0025 362/223 |
| 2013/0250556 | A1 | 9/2013 | Gordin et al. | |
| 2014/0016322 | A1 * | 1/2014 | Lu | F21V 14/04 362/282 |

* cited by examiner

PIVOTABLE LIGHT FIXTURE

CROSS-REFERENCE TO RELATED APPLICATION

This application is related to and claims priority to U.S. Provisional Patent Application Ser. No. 62/061,465, filed Oct. 8, 2014, entitled PIVOTABLE LIGHT FIXTURE, the entirety of which is incorporated herein by reference.

STATEMENT REGARDING FEDERALLY SPONSORED RESEARCH OR DEVELOPMENT n/a

TECHNICAL FIELD

The present invention relates to light fixtures, and in particular, pivotable light fixtures.

BACKGROUND OF THE INVENTION

Modern light fixtures are typically mounted to walls by screwing the light fixture to a plate disposed over an electrical junction box, which is affixed inside a wall. The junction box is typically an open metal box that includes one or more live wires, a neutral wire, and a ground wire that extend out of the box for connection to a light fixture. The plate provides a conduit though which the wires may extend out through the wall to connect with complementary wires in the fixture to complete a circuit and provide electricity to one or more lights attached to the fixture.

Some wall mounted fixtures, typically referred to as sconces, provide light only in a single direction. That is, the light emitted from the sconces is directed either upward, downward, or outward, but the direction of light is not adjustable between the three directions. Thus, these sconces only provide for a single way to direct light. Other sconces, typically used in outdoor environments, include one or more light housings that are movably connected to the fixture, all of which extend a distance away from the wall. Such fixtures allow for the lateral movement of the light housings to direct the light emitted form bulbs inside the light housings. However, this side-to-side movement of the light housings requires the user to adjust each light housing separately for the desired direction for the light to be emitted. Moreover, such fixtures, when properly installed, are immovable and extend away from a wall, often creating displeasing appearance.

SUMMARY

The present invention advantageously provides for a pivotable wall mounted light fixture recessed within the wall of a structure. The light fixture includes a housing, the housing including a back portion and a plurality of side walls extending from the back portion, the back portion and the plurality of side walls defining an opening and an interior therein. A light source is affixed to the back portion within the interior. A hinge is coupled to the housing and positioned within the interior, the hinge includes a first portion and a second portion, the first portion and second portion being configured to reflect light emitted from the light source. The first portion and the second portion being movable contemporaneously from a first portion in which light from the light source is substantially entirely reflected in a first direction away from the housing to a second position in which light is substantially entirely reflect reflected away from the housing in a second direction different than the first direction.

In another embodiment, the light fixture includes a housing, the housing includes a back portion and a plurality of side walls extending from the back portion. The back portion and the plurality of side walls define an opening and an interior therein, the back portion further defining a major longitudinal axis and a plurality of slats. A light source is affixed to the back portion within the interior. A hinge is coupled to the housing and positioned within the interior, the hinge includes a first substantially planar portion and a second substantially portion defining a obtuse angle with the first substantially planar portion, the first substantially planar portion and second substantially planar portion being configured to reflect light emitted from the light source. The first substantially planar portion and the second substantially planar portion being movable contemporaneously from a first portion in which light from the light source is substantially entirely reflected in a first direction away from the housing and substantially parallel to the major longitudinal axis, to a second position in which light is substantially entirely reflect reflected away from the housing in a second direction opposite the first direction and substantially parallel to the major longitudinal axis.

In yet another embodiment, the light fixture includes a housing, the housing includes a back portion and a plurality of side walls extending from the back portion, the back portion and the plurality of side walls defining an opening and an interior therein, the back portion further defining a major longitudinal axis and a plurality of slats. A light source is affixed to the back portion within the interior. A hinge is pivotally coupled to the housing and disposed between two of the plurality of side walls and positioned within the interior. The hinge includes a substantially cylindrical element and first substantially planar portion and a second substantially portion defining a obtuse angle with the first substantially planar portion extending from the substantially cylindrical element, the first substantially planar portion and second substantially planar portion being configured to reflect light emitted from the light source. The first substantially planar portion and the second substantially planar portion being movable contemporaneously from a first portion in which light from the light source is substantially entirely reflected in a first direction away from the housing and substantially parallel to the major longitudinal axis, to a second position in which light is substantially entirely reflect reflected away from the housing in a second direction opposite the first direction and substantially parallel to the major longitudinal axis. A shade element is coupled to the first substantially planar portion and the second substantially planar portion, the shade element configured to diffuse light emitted from the light source, the shade element be configured to substantially concealing the opening.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

As used here, relational terms, such as "first" and "second," "top" and "bottom," "front and rear," and the like, may be used solely to distinguish one entity or element from another entity or element without necessarily requiring or implying any physical or logical relationship or order between such entities or elements.

Figure 1:
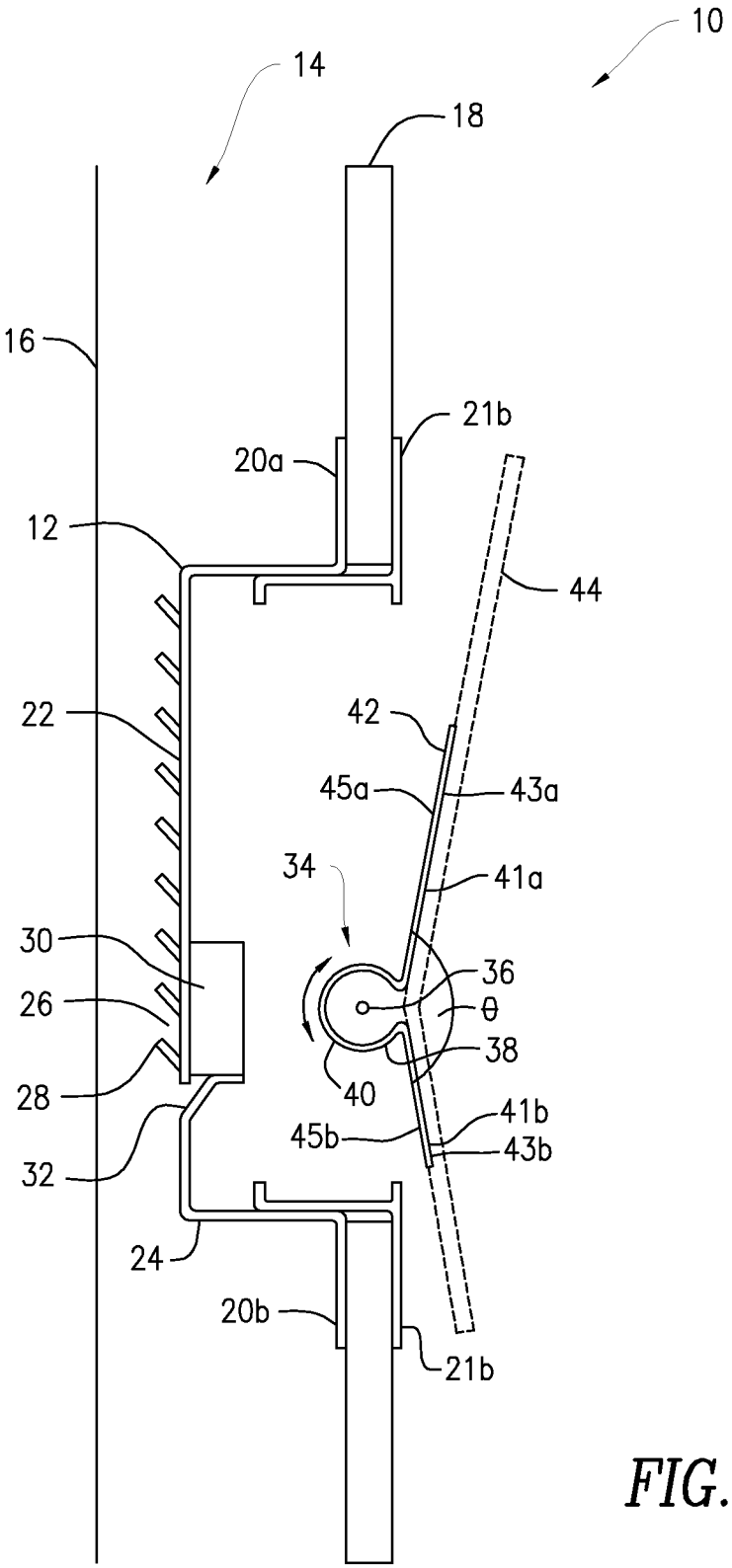
FIG. 1 is a side cross-sectional view of a light fixture constructed in accordance with the principles of the present invention.

Now referring to drawings in which like reference designators refer to like elements, there is shown in FIG. 1 an exemplary light fixture constructed in accordance with the principles of the present invention and designated generally as "10." The light fixture 10 may include a housing 12 configured to be coupled or otherwise disposed in a space 14 between a stud wall 16, for example, cement block, and a dry wall 18. The housing 12 may be an open box shape, or any shape allowing access to the interior of the housing 12 and may be composed of materials such as metals, metal, alloys, plastics or other materials. In one configuration, the housing 12 is composed of material with a high specific heat such that the temperature within the housing 12 remains approximately at room temperature. The housing 12 may be affixed to a dry and/or plaster wall 18, or other side or ceiling wall, and extend into the space 14 where it may receive one or more wires (not shown) connected to a power source. For example, it is contemplated that for existing structures, such as buildings and homes, the housing 12 may replace existing junction boxes or may be installed into new construction homes as a substitute for existing junction boxes. In other configurations, the housing 12 may be installed on the ceiling, floor, or other structures within the structure to provide for a desired lighting. Alternatively, the housing 12 may be mounted to free-standing structures such as lamps.

The housing 12 may be affixed to dry wall 18 by methods known in the art. For example, the housing 12 may define lips 20*a* and 20*b* on opposite ends of the housing 12 that are each anchorable to the dry wall 18 such that they are substantially parallel to the dry wall 18 when the housing 12 is affixed to the dry wall 18. The lips 20*a* and 2*b* may include substantially L-shaped connectors 21*a* and 21*b* respectively, the connectors 21*a* and 21*b* define a pocket with their respective lips 20*a* and 20*b* such that a portion of the dry wall 18 may be received within the pocket such that the housing 12 may be mounted to both sides of the dry wall 18.

The housing 12 may include a back portion 22 and a plurality of side walls 24 extending from the back portion 22 that collectively define and interior within the housing 12. The plurality of side walls 24 may be substantially perpendicular to the back portion 22 and in an exemplary configuration, four side walls 34 are included extending from the back portion 22. The back portion 22 may define a plurality of slots 26 along its length that cooperate to define a heat sink and for dissipation of any heat generated by a light source 30 retained within. A plurality of slats 28 may further be included extending from the back portion 22 away from the housing 12. The slats 28 may be proximate the slots 26 and function to direct any heat generated from the light source 30 away from the housing 12.

Continuing to refer to FIG. 1, the housing 12 may include the light source 30 within a portion of its interior. In an exemplary configuration, the light source 30 is affixed to the back portion 22 proximate the bottom of the back portion 22 when the housing 12 is affixed to the dry wall 18. In particular, owing to the fact that heat rises, positioning the light source 30 proximate the bottom of the housing 12 allows for heat to be dissipated by the slots 26 and slats 28 as the heat rises within the housing 12. The housing 12 may further define one or more openings 32 for one of more live, ground, and neutral wires (not shown) to enter the housing 12 and connect to the light source 30. The light source 30 may be an array of LEDs, a compact fluorescent bulb, or incandescent bulb. In an exemplary configuration, the light source 30 is an array of LED's extending vertically along the back portion 22. In other configurations, a plurality of light sources 30 may be included disposed along any portion of the housing 12.

Figure 2:
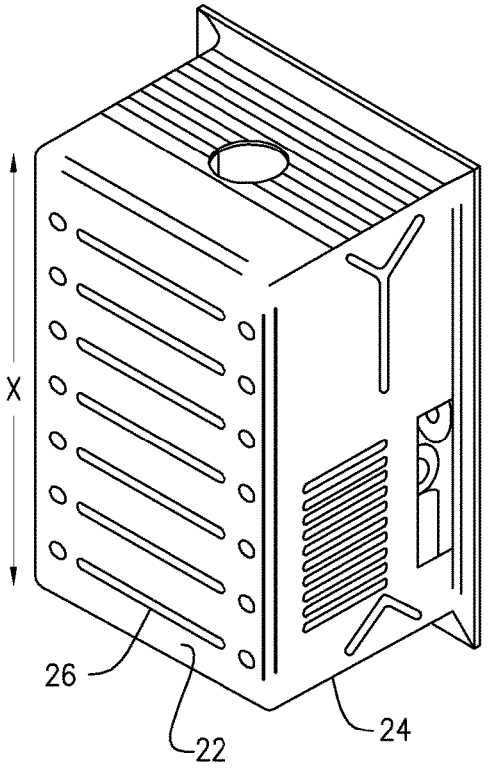
FIG. 2 is a back perspective view and a front perspective view of a light fixture constructed in accordance with the principles of the present invention.
Figure 3:
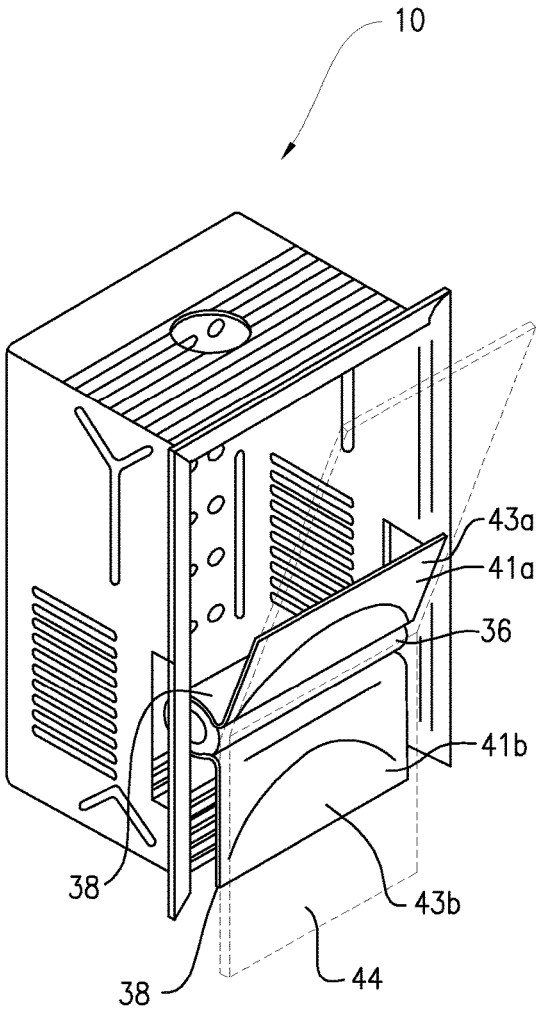
FIG. 3 is a front perspective view and a front perspective view of the light fixture shown in FIG. 2.

Referring now to FIGS. 1-3, the fixture 10 may further including a hinge 34 removably couplable to the housing 12. The hinge 34 may be pivotably coupled to the housing 12 such that it is movable and/or rotatably to a plurality of radial positions. In particular, the hinge 34 may optionally include a shaft 36 rotatable fixed to opposite sides of the plurality of side walls 24. The shaft 36 may be connected to a substantially cylindrical element 38 shown in FIGS. 1-3 substantially spanning the width of the housing 12. In other configurations, no shaft 36 is included and the substantially cylindrical element 38, or any shaped pivoting element 38, is directly and pivotably connected to the housing 12. In the configuration shown in FIG. 2, the substantially cylindrical element 38 is disposed in a configuration in which it is substantially perpendicular to the length of the back portion 22. In such a configuration, the substantially cylindrical element 38 may rotate up and down about the shaft 36 to direct light toward the ceiling or toward the ground as discussed in more detail below. In other configurations, the substantially cylindrical element 38 is disposed in a positioned substantially parallel to the length of the back portion 22 and is connected to the top and bottom sidewall walls 24. In such a configuration, the substantially cylindrical element 38 may rotate from side-to-side about the shaft 36 to direct light toward the walls of the room rather than the ceiling or floor. In other configurations, the substantially cylindrical element 38 may rotatably affixed to the housing 12 such that it may be rotatable affixed to a plurality of radial positions within the housing such that light may be emitted in any direction. For example, a gimbal (not shown) may be included instead of the pivoting element 28 to provide for 180 degree rotation of the hinge 34

Figure 4:
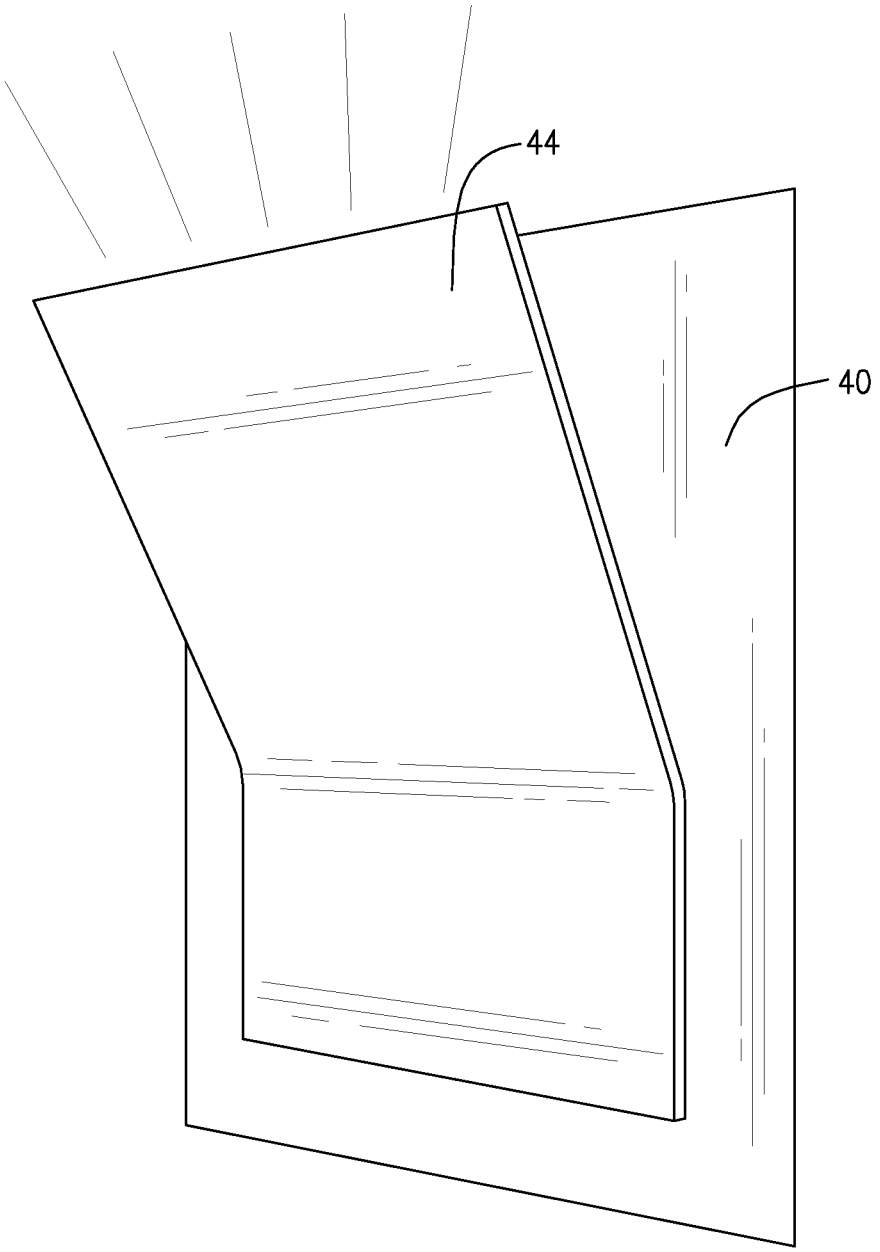
FIG. 4 is a front perspective view and a front perspective view of a light fixture constructed in accordance with the principles of the present invention with light directed toward the ceiling.
Figure 5:
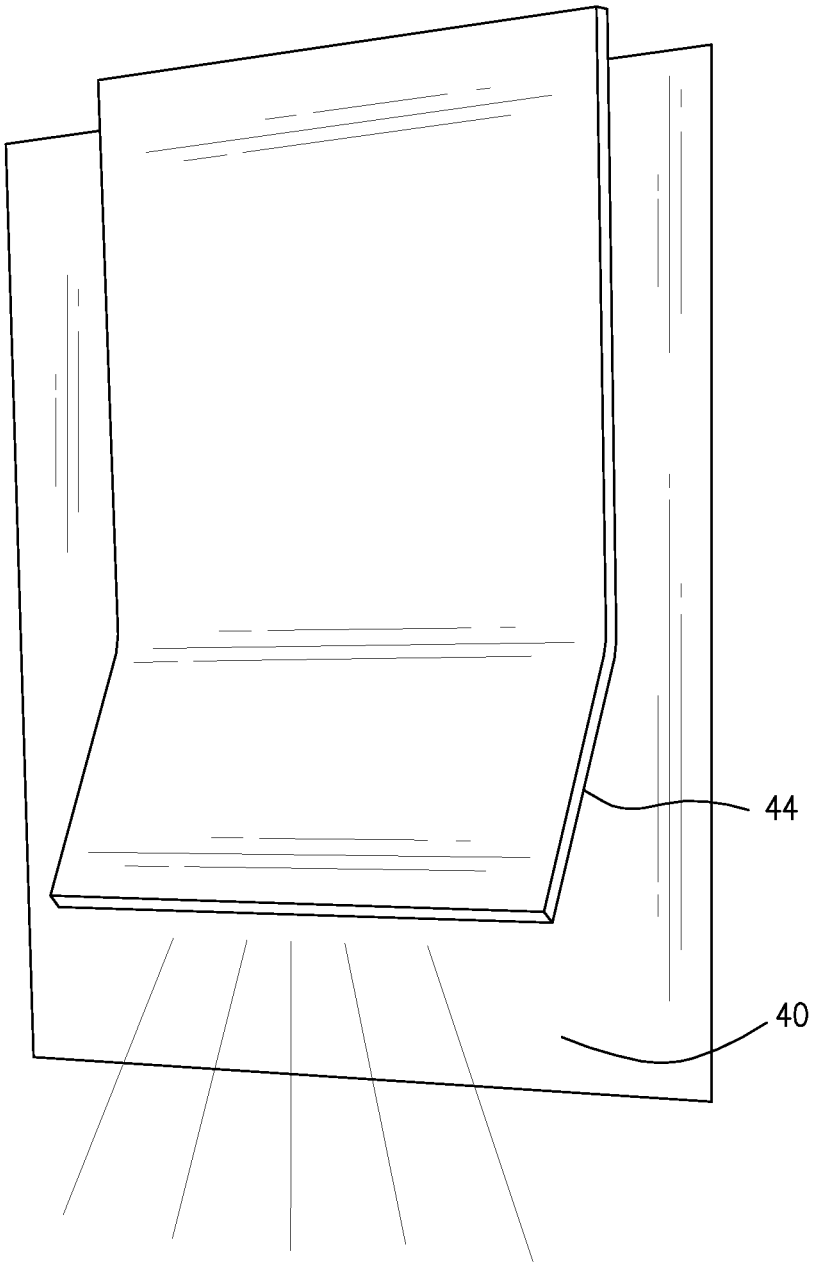
FIG. 5 is a front perspective view and a front perspective view of the light fixture shown in FIG. 4 with light directed toward the floor.
Figure 6:
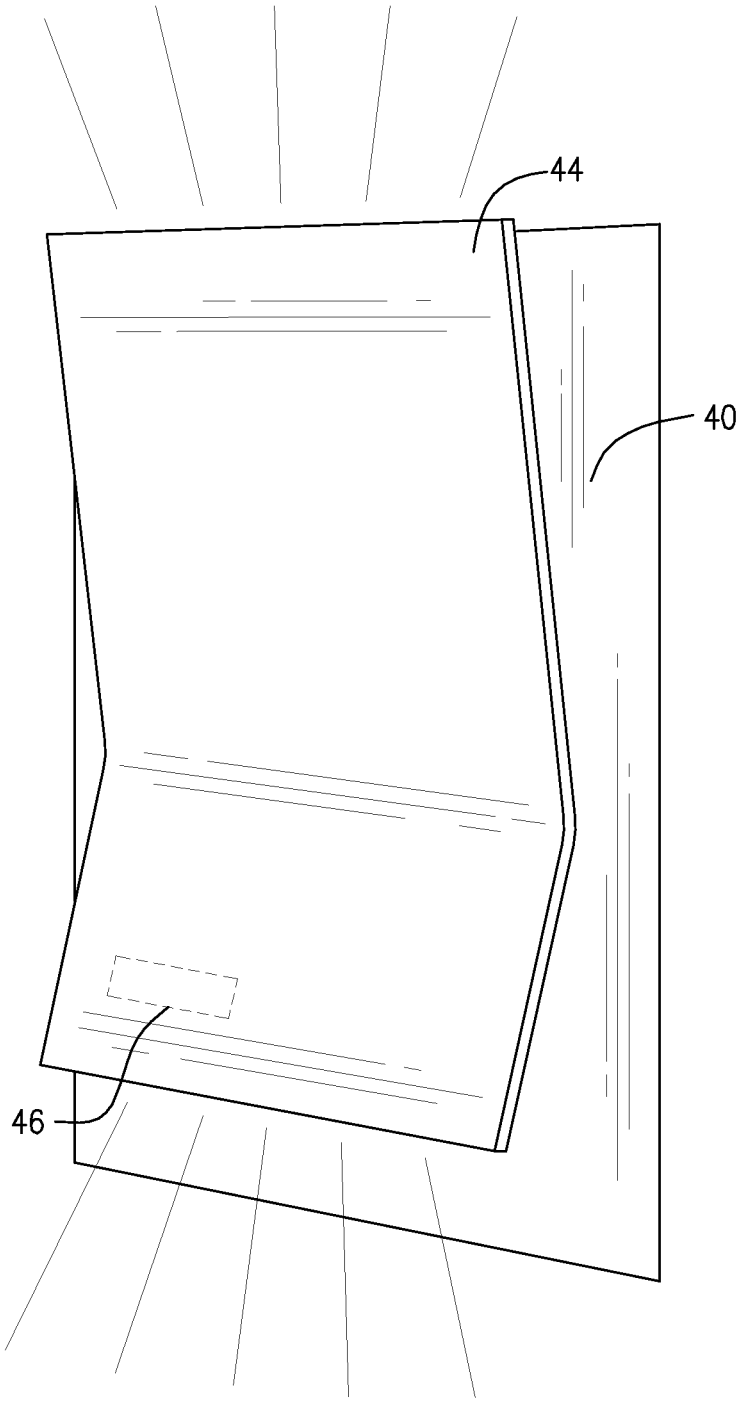
FIG. 6 is a front perspective view and a front perspective view of the light fixture shown in FIG. 4 with light directed toward both the floor and the ceiling.

Continuing to refer to FIG. 1, optionally substantially circumferentially surrounding the substantially cylindrical element 38, or connected thereto, may be a diffuser 40 (best seen in FIGS. 4-6). The diffuser 40 may act as a prism to diffuse the light emitted from the light source 30 such that the light may be directed or modified to a desired. In on configuration, the diffuser 40 may extend out of the housing 12, as shown in FIGS. 4-6, and may be any shape or size depending on the desired appearance of the light fixture 10 and the direction of light to be emitted. For example, the diffusor 40 may be a substantially planar material, for example, plastic disposed in front of the hinge 34 such that light may be diffused at it is emitted out of the housing 12.

The hinge 34 may further include a first portion 41*a* and a second portion 41*b* extending from the hinge 34. For example, the first portion 41*a* may extend in a first direction away from the hinge 34 and the second portion 41*b* may extend in a second direction, different than the first direction, away from the hinge 34. The first portion 41*a* and the second portion 41*b* may be each substantially planar in configured and may define a fixed or adjustable angle between them. For example, as shown in FIG. 1, the first portion 41*a* and the second portion 41*b* may define a fixed obtuse angle "θ" between them, for example, 175°. Alternatively, the angle θ may be adjustable by bending the first portion 41*a* and/or the second portion 41*b* with respect to the other. For example, in a configuration in which the first portion 41*a* and the second portion 41*b* are composed of a malleable material, the first portion 41*a* and the second portion 41*b* may be manipulated to adjust the angle θ.

Connected to the substantially cylindrical element 38 and/or the first portion 41*a* and the second portion 41*b* may be a reflector 42, for example, a mirror or a piece of reflective metal. The reflector 42 is configured to reflect the light emitted from the light source 30 in desired directions out of the housing 12. For example, the reflector 42 may extend in any direction from the substantially cylindrical element 38, for example, toward the top and bottom of the housing 12 or side-to-side. The distance the reflector 42 extends may be variable depending on the desired direction the light is to be directed. In other configurations, the substantially cylindrical element 38 and the reflector 42 may be continuous and composed of the same material. For example, the substantially cylindrical element 38 may be composed of a reflective metal and it may extend from an open loop defined by the substantially cylindrical element 38 to define the first portion 41*a* and the second portion 41*b*. In such a configuration, the first portion 41*a* may define a first side 43*a* facing the interior and a second side 45*a* opposite the first side 43*a*. Similarly, the second portion 41*b* may define a first side 43*b* facing the interior and a second side 45*b* opposite the first side 43*b*. The reflector 42 may be coated or affixed to the surface of the first side 43*a* and the first side 43*b* to reflect light away from the housing 12.

Referring now to FIGS. 3-6, a shade element 44 may removeably or permanently affixed to hinge 34 and in particular the first portion 41*a* and the second portion 41*b*. The shade element 44 may be substantially planar in shape and may be substantially co-planar with the second side 45*a* and the second side 45*b* and operates to direct light emitted and/or diffused by the diffuser 40. In other configurations, the shade element may be any shape or size, for example, circular or star-shaped. In particular, as shown in FIGS. 4-6, the shade element 44 may be opaque and/or partially translucent as to diffuse light emitted from the light source 30 and may further define a greater longitudinal length from top to bottom and area as compared to the combined longitudinal length of the first portion 41*a* and the second portion 41*b* such that the shade element 44 substantially conceals the interior of the housing 12. In one configuration, the shade element 44 may further include a removable cloth material or other covered disposed on its outer face to add a design feature to the fixture 10.

In an exemplary use of the fixture 10, the user may actuate the light source 30 by either an external switch or an internal switch which may be connected to the hinge 34 and the light source 30. In particular, movement of the first portion 41*a* towards the wall 18 such that it is secured in a position substantially parallel with the wall 18 and/or the major longitudinal axis "x" of the housing 12 (shown in FIG. 2) causes the contemporaneous movement of the second portion 41*a* away from the wall such that the light emitted from the light source 30 is substantially entirely reflected light downward towards the floor. Movement of the second portion 41*b* towards the wall 18, causes the contemporaneous movement of the first portion 41*a* away from the wall such that it is secured in a position substantially parallel with the wall 18 and/or the major longitudinal axis of the housing 12, causes the light emitted from the light source 30 to be substantially entirely reflected light upward towards the ceiling. In such configurations, a pushing force applied to the shade 44 at the respective positions of the first portion 41*a* and the second portion 41*b* moves the respective one of the first portion 41*a* and the second portion 41*b*.

In the configuration shown in FIG. 6, the first portion 41*a* and second portion 41*b* may be moved to a position such that light is emitted both upward and downward or side-to-side depending on the orientation of the hinge 34. Alternatively, the light source 30 may be off or on when the first portion 41*a* and the second portion 41*b* are in a neutral position as shown in FIG. 5, for example, each an inch away from the wall, the light source 30 may be switched on or off. Thus, the contemporaneous movement of the first portion 41*a* and the second portion 41*b* may operate as a switch to turn on/off the light source 30 within the housing.

Optionally, the shade element 44 may be touch sensitive and may include a touch switch 46 on its surface configured to control the light intensity, color, and/or temperature of the light source 30. For example, the touch switch 46 may be pressure sensitive and may be disposed on the surface of the shade element 44. The touch switch 46 may be in wireless communication with a processor (not shown) disposed within the device 10, for example, within the housing 12 or within or coupled to the shade 44. In operation, the user may tap and/or swipe on the touch switch to dim/raise the light source 30, turn on/off the light 30, and or adjust the color of the light source 30. For example, the light source 30 may be configured to change to any desired color and the color may be changed by swiping on the touch switch 46.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A light fixture, comprising:

a housing, the housing including a back portion and a plurality of side walls extending from the back portion, the back portion and the plurality of side walls defining an opening and an interior therein;

a light source affixed to the back portion within the interior;

a hinge coupled to the housing and positioned within the interior, the hinge including a first portion and a second portion, the first portion and second portion being configured to reflect light emitted from the light source;

the first portion and the second portion being movable contemporaneously from a first position in which light from the light source is substantially reflected in a first direction away from the housing to a second position in which light is substantially reflected away from the housing in a second direction different than the first direction; and a shade element coupled to the second side, the shade element being configured to diffuse light emitted from the light source.

2. The light fixture of claim 1, wherein the hinge includes a substantially cylindrical element, and where the first portion and the second portion are at least partially rotatable about the cylindrical element.

3. The light fixture of claim 2, further including a diffuser disposed around at least a portion of the substantially cylindrical element.

4. The light fixture of claim 3, wherein the first portion and the second portion each include a first side facing the interior and a second side opposite the first side, and wherein the first side includes a reflector.

5. The light fixture of claim 4, wherein the shade element includes a first part and a second part, and wherein the first part is substantially co-planar with the first side and the second part is substantially co-planar with the second side.

6. The light fixture of claim 4, wherein the shade element is configured to substantially conceal the opening.

7. The light fixture of claim 1, wherein the first portion and the second portion are disposed at an obtuse angle with respect to each other.

8. The light fixture of claim 1, wherein the housing defines a plurality of slots configured to dissipate heat emitted from the light source.

9. The light fixture of claim 1, wherein the housing defines at least one pocket configured to receive a portion of a wall.

10. The light fixture of claim 1, wherein the first portion and the second portion are fixed in the first position until moved to the second position.

11. The light fixture of claim 1, wherein the hinge is coupled between two of the plurality of side walls.

12. The light fixture of claim 5, wherein the first portion and the second portion define a first length, and wherein the first part and the second part define a second length, and wherein the second length is greater than the first length.

13. A light fixture, comprising:

a housing, the housing including a back portion and a plurality of side walls extending from the back portion, the back portion and the plurality of side walls defining an opening and an interior therein, the back portion defining a major longitudinal axis and a plurality of slats;

a light source affixed to the back portion within the interior;

a hinge coupled to the housing and positioned within the interior, the hinge including a first substantially planar portion and a second substantially planar portion defining an obtuse angle with the first substantially planar portion, the first substantially planar portion and second substantially planar portion being configured to reflect light emitted from the light source; and the first substantially planar portion and the second substantially planar portion being movable contemporaneously from a first position in which light from the light source is substantially reflected in a first direction away from the housing and substantially parallel to the major longitudinal axis, to a second position in which light is substantially reflected away from the housing in a second direction opposite the first direction and substantially parallel to the major longitudinal axis.

14. The light fixture of claim 13, wherein the first substantially planar portion and the second substantially planar portion are movable to a third position in which light is directed in both the first direction and the second direction.

15. The light fixture of claim 13, wherein the housing defines at least one pocket configured to receive a portion of a wall.

16. The light fixture of claim 14, wherein the first substantially planar portion and the second substantially planar portion are fixed in the third position until moved to at least one of the first position and the second position.

17. The light fixture of claim 13, wherein the hinge is coupled between two of the plurality of side walls.

18. The light fixture of claim 13, further including a shade element coupled to the first substantially planar portion and the second substantially planar portion, the shade element configured to diffuse light emitted from the light source.

19. A light fixture, comprising:

a housing, the housing including a back portion and a plurality of side walls extending from the back portion, the back portion and the plurality of side walls defining an opening and an interior therein, the back portion defining a major longitudinal axis and a plurality of slats;

a light source affixed to the back portion within the interior;

a hinge pivotally coupled to the housing and disposed between two of the plurality of side walls and positioned within the interior, the hinge including a substantially cylindrical element and first substantially planar portion and a second substantially planar portion defining an obtuse angle with the first substantially planar portion extending from the substantially cylindrical element, the first substantially planar portion and second substantially planar portion being configured to reflect light emitted from the light source; and the first substantially planar portion and the second substantially planar portion being movable contemporaneously from a first position in which light from the light source is substantially reflected in a first direction away from the housing and substantially parallel to the major longitudinal axis, to a second position in which light is substantially reflected away from the housing in a second direction opposite the first direction and substantially parallel to the major longitudinal axis; and a shade element coupled to the first substantially planar portion and the second substantially planar portion, the shade element configured to diffuse light emitted from the light source, the shade element configured to substantially conceal the opening.

* * * * *